US009403398B2

(12) United States Patent
Latosquin, III

(10) Patent No.: US 9,403,398 B2
(45) Date of Patent: Aug. 2, 2016

(54) NOTEPAD COVER

(71) Applicant: Agustin M. Latosquin, III, Irvine, CA (US)

(72) Inventor: Agustin M. Latosquin, III, Irvine, CA (US)

( * ) Notice: Subject to any disclaimer, the term of this patent is extended or adjusted under 35 U.S.C. 154(b) by 0 days.

(21) Appl. No.: 14/694,047

(22) Filed: Apr. 23, 2015

(65) Prior Publication Data

US 2015/0314627 A1 Nov. 5, 2015

Related U.S. Application Data

(60) Provisional application No. 61/987,572, filed on May 2, 2014.

(51) Int. Cl.

| | |
|---|---|
| ***B42D 3/16*** | (2006.01) |
| ***B42F 7/04*** | (2006.01) |
| ***B42D 5/00*** | (2006.01) |
| ***B42D 3/06*** | (2006.01) |
| *B43L 3/00* | (2006.01) |

(52) U.S. Cl.

CPC *B42D 5/005* (2013.01); *B42D 3/06* (2013.01); *B42D 3/16* (2013.01); *B42F 7/04* (2013.01); *B43L 3/00* (2013.01)

(58) Field of Classification Search

CPC ..... B42D 5/005; B42D 3/16; B42F 7/04

USPC ..... 281/19.1, 29, 44, 45; D19/27

See application file for complete search history.

(56) References Cited

U.S. PATENT DOCUMENTS

| | | | | | |
|---|---|---|---|---|---|
| 352,358 | A * | 11/1886 | Scherer | A47B 97/08 281/45 |
| 1,492,677 | A * | 5/1924 | Dunbar | A45F 5/12 281/19.1 |
| 1,591,173 | A * | 7/1926 | Mackey | B42D 3/045 281/34 |
| 1,977,794 | A * | 10/1934 | Garraway | B42F 11/00 402/79 |
| 2,317,748 | A * | 4/1943 | Exline | B42D 5/022 281/19.1 |
| 2,828,975 | A | 4/1958 | Wright | |
| 5,020,673 | A | 6/1991 | Adams | |
| 5,215,398 | A | 6/1993 | White et al. | |
| 5,445,251 | A | 8/1995 | Redwood | |
| 5,752,589 | A | 5/1998 | Berg | |
| 2007/0114783 | A1 * | 5/2007 | Glosh | B42D 3/00 281/29 |

FOREIGN PATENT DOCUMENTS

| | | | |
|---|---|---|---|
| EP | 002380457 | A * | 10/2011 |
| FR | 002626748 | A1 * | 8/1989 |
| GB | 000915324 | A * | 1/1963 |
| GB | 001520380 | A * | 8/1978 |
| KR | 20110107270 | A * | 9/2011 |

* cited by examiner

*Primary Examiner* — Kyle Grabowski

(74) *Attorney, Agent, or Firm* — Daniel Boudwin; Global Intellectual Property Agency

(57) ABSTRACT

A notepad cover for support and protection is provided. The notepad cover includes at least three panels that are removably attachable to a notepad. The at least three panels include a first panel, a second panel, and a third panel. The first panel and third panel are hingedly connected to opposing ends of the second panel. A notepad is securable within the first panel and the second panel via an elastic band. The third panel is adapted to fold in between the notepad secured therein to provide support and protection for the notepad pages therein. The third panel may also fold behind the second panel and serve as a rigid support to write or draw thereon.

9 Claims, 2 Drawing Sheets

NOTEPAD COVER

CROSS REFERENCE TO RELATED APPLICATION

This application claims the benefit of U.S. Provisional Application No. 61/987,572 filed on May 2, 2014. The above identified patent application is herein incorporated by reference in its entirety to provide continuity of disclosure.

FIELD OF THE INVENTION

The invention generally relates to a notepad cover. More specifically, the present invention relates to a rigid notepad cover having at least three panels that provide support and protection for a notepad and a notepad's pages secured therein.

BACKGROUND OF THE INVENTION

Many individuals employ the use of writing pads, such as steno pads, notebooks and the like, for writing, taking notes and drawing. Notebooks used to hold sheets of paper have been widely used for many years and utilize a flat, rectangular supporting platform and a working surface over the supporting platform which typically is a stack of paper. The user can either rest the supporting platform on a solid surface or hold the notepad by one hand, and at the same time use another hand to work on the working surface.

In general, notebooks have been used to cover the writing area of sheets of paper to protect the writings contained thereon. Accordingly, covers on notebooks have typically been configured and dimensioned to match the writing area. Many notebook covers have been constructed with paper or plastic materials to add further protection to the sheets of writing paper. However, paper and plastic materials are substantially flexible and, thus, leave the writing paper susceptible to damage, such as from impact.

These pads often have fragile covers that are not conducive to writing when standing or on the go. The writing surface is unstable and unbalanced when held upright which leads to inaccurate writing and drawing. Additionally, these writing pad covers do not offer much protection from spills, rainy weather and the like and the pages of these pads can become damaged easily, thus ruining the notes and drawings thereon.

Various devices have been described in prior art relating to notepad covers and clipboards to support and protect notepads. These include devices that have been patented and published in patent application publications. These devices generally relate to folders and portfolios that provide protection to materials contained therein. The following is a list of devices deemed most relevant to the present disclosure, which are herein described for the purposes of highlighting and differentiating the unique aspects of the present invention, and further highlighting the drawbacks existing in the prior art.

These prior art devices have several known drawbacks. Each of these devices addresses the need for portable writing surfaces and in some cases storage of supplies, writing implements and drafting tools. The current invention goes beyond the present art to provide a three panel notepad cover that provides support and protection for the notepad pages contained therein. It incorporates a surface area that allows a user to write while standing upright or on the go.

In light of the devices disclosed in the prior art, it is submitted that the present invention substantially diverges in design elements from the prior art and consequently it is clear that there is a need in the art for an improvement to existing notepad covers. In this regard the instant invention substantially fulfills these needs.

SUMMARY OF THE INVENTION

In view of the foregoing disadvantages inherent in the known types of notepad covers now present in the prior art, the present invention provides an improved notepad cover wherein the same can be utilized for providing convenience for the user when supporting and protecting the writings in a notepad.

It is therefore an object of the present invention to provide a new and improved notepad cover that has all of the advantages of the prior art and none of the disadvantages.

It is one object of the present invention to provide a notepad cover for support and protection of notepad pages therein. The notepad cover includes at least three panels removably attached to a notepad. The at least three panels include a first panel, a second panel, and a third panel.

It is another object of the present invention to provide a notepad cover wherein the first panel and third panel are hingedly connected to opposing ends of the second panel. The second panel and the first panel are hingedly connected to one another via a fastener or may be sewn together. The hinged connection between the panels provide a cavity to receive notepad rings, bindings, and the like.

Another object of the present invention is to provide a notepad cover wherein the notepad is detachably secured within the first panel and the second panel via a plurality of fasteners, such as an elastic band. The first panel and second panel includes the flat elastic band positioned vertically on an interior of the first panel and the second panel. The flat elastic band is configured to secure the notepad thereunder.

It is yet another object of the present invention to provide a notepad cover wherein the third panel is hingedly connected to the second panel such that third panel folds in between the notepad secured within the second panel and the first panel. The third panel is placed in between the notepad to separate pages of the notepad.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
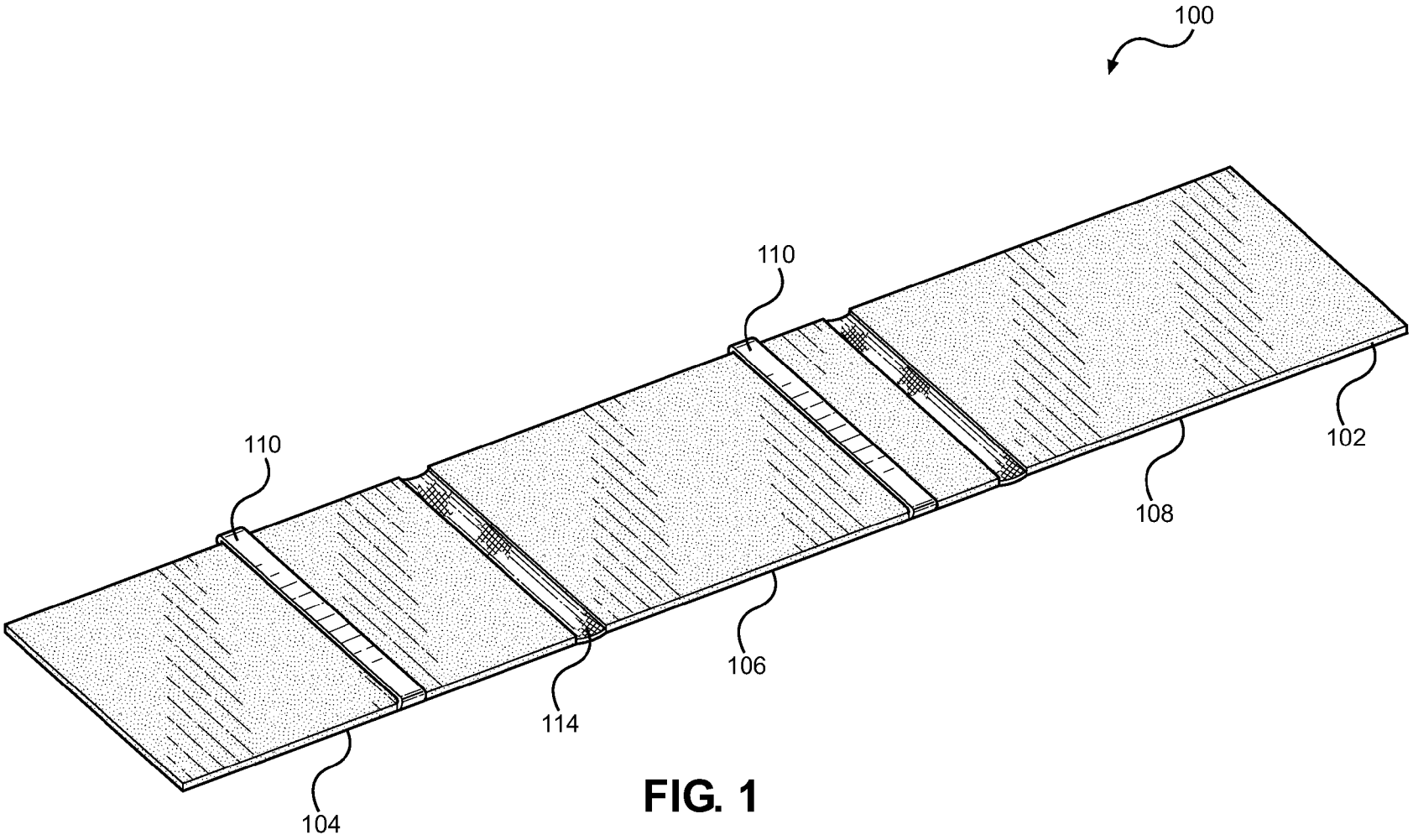
FIG. 1 shows an overhead view of the panels of the notepad cover according to one embodiment of the present invention.

Reference is made herein to the attached drawings. Like reference numerals are used throughout the drawings to depict like or similar elements of the notepad cover. For the purposes of presenting a brief and clear description of the present invention, the preferred embodiment will be discussed as used for writing pads and notepads. The figures are intended for representative purposes only and should not be considered to be limiting in any respect.

Referring now to FIG. 1, there is shown an overhead view of the panels of the notepad cover according to one embodiment of the present invention. The notepad cover 100 supports and protects a notebook positioned therein. The notepad cover 100 can be used in conjunction with notebooks, drawing pads, notepads and the like. The notepad cover 100 provides a hard and stable three-panel cover on which a user can write and draw while standing upright.

The notepad cover 100 includes at least three panels 102 removably attachable to a notepad. The at least three panels 102 include a first panel 104, a second panel 106, and a third panel 108. The notepad cover 100 includes three to four panels that can be constructed from a thin, hard material that can be covered in leather or other suitable material. The panels 102 comprise a substantially rigid material. The panels 102 can be affixed to one another via adhesive, elastic material, coils, sewing, or other such means. In one embodiment, the hinged connection 114 comprises a nylon, cotton, or cotton blend stitch.

The first panel 104 and the third panel 108 are hingedly connected 114 to opposing ends of the second panel 106. The first panel 104 and the second panel 106 cover the front and back sides of a notepad, respectively. The notepad is received between the first panel 104 and the second panel 106 and is secured therein. The third panel 108 is placed behind a notebook page to provide a rigid hard writing surface or may be placed within the notepad to protect individual pages of the notepad.

The notepad is detachably secured to the second panel 106 and the first panel 104 via a plurality of fasteners, such as an elastic band 110. The first panel 104 and second panel 106 include a flat elastic band 110 positioned vertically on an interior of the first panel 104 and the second panel 106. The flat elastic band 110 is configured to secure the notepad thereunder. According to one embodiment, the elastic band 110 secures a notepad cover to the interior of the second panel 106 and is held flush against the second panel 106 interior surface. It is contemplated that there may a plurality of elastic bands 110 disposed on the interior of the second panel 106, as well as the first panel 104. In alternate embodiment, the fasteners may include a cloth band, a leather band or a clamp.

The third panel 108 is hingedly connected 114 to the second panel 106. The third panel 108 serves as an additional panel for support and protection for the notepad. The hinged connection allows the third panel 108 to be placed into a desired location in the notepad to provide a rigid surface on which a use can write or draw on a notebook page. It is preferably located behind a writing surface to provide added support for a user while writing or drawing. The third panel 108 folds in between the notepad secured within the second panel 106 and the first panel 104. The third panel 108 serves as a flap that can fold in between the pad and can be used to protect the pages of the pad or provide a rigid writing surface.

In one embodiment, the notepad cover 100 may include at least two panels removably attached to a notepad. The at least two panels include a first panel and an elongated second panel. The notepad is detachably secured to the first panel and the second panel via a fastener. The second panel is hingedly connected to the first panel such that the second panel folds in between the notepad secured within the first panel and the second panel.

Figure 2:
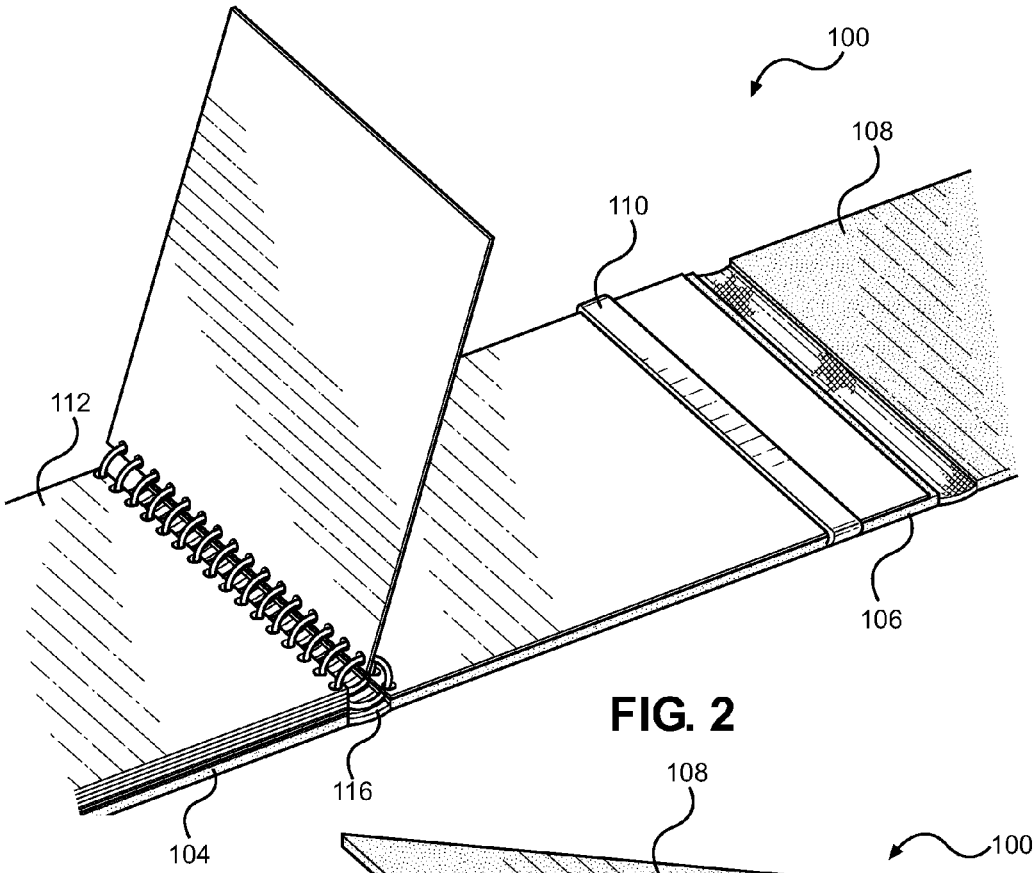
FIG. 2 shows a perspective view of the notepad cover affixed to a notepad according one embodiment of the present invention.
Figure 3:
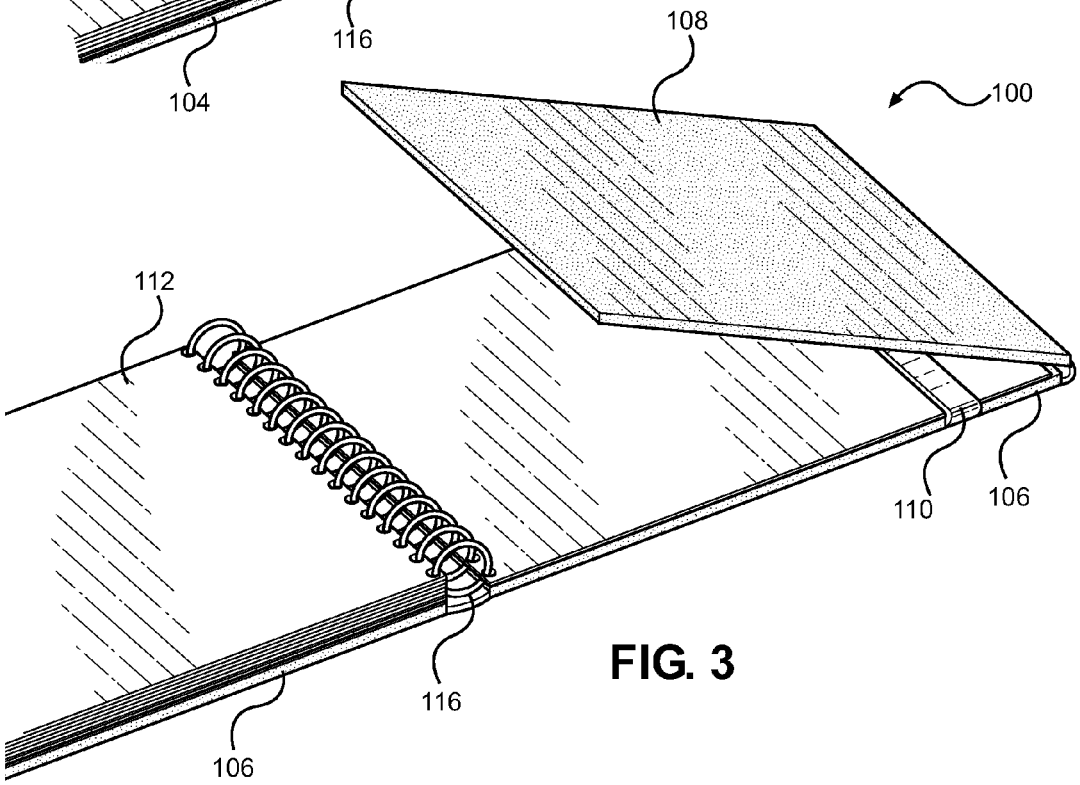
FIG. 3 shows a perspective view of the notepad cover affixed to a notepad according one embodiment of the present invention.

Referring now to FIGS. 2 and 3, there are shown perspective views of the notepad cover affixed to a notepad according one embodiment of the present invention. A notepad 112 is affixed to the interior of the first panel 104 and the second panel 106. The notebook 112 is slid underneath an elastic band 110 provided on the interior of the first panel 104 and the second panel 106. The elastic band 110 may comprise a short length of rubber and latex. The elastic band 100 secures the notepad 112 between the first panel 104 and the second panel 106.

The notepad cover 100 comprises at least a first panel 104 and a second panel 106 that can cover the front and back sides of a notepad 112 or other similar device. The third panel 108 provides a hard writing surface that can be placed behind the back of a notepad 112 page to easily write thereon. The third panel 108 is hingedly connected to the second panel 106 such that the third panel 108 be placed behind any page in a notepad 112 desired by the user. The hinged connection between the second panel 106 and the third panel 108 allows the third panel 108 to pivot between two configurations. The third panel 108 can be placed behind the second panel 106 or in between the first panel 104 and the second panel 106. It is contemplated that the notepad cover 100 can include three to four panels, or flaps, that can be constructed from a thin and hard material that can be covered in leather or other suitable material. The panels or flaps can be affixed to one another via an adhesive, elastic material, sewing means, or other suitable fastening means.

According to another embodiment, the notepad cover 100 provides a device in which a notepad 112 can be placed therein in order to protect the pad and pages from harsh weather and other external factors. The notepad cover 100 comprise panels that can be made of a thin layer of leather or plastic material. Alternatively, the panels can be made of plastic, wherein the panels can be attached to one another via thin elastic flat strings 116 sewn in between each of the panels. The elastic flat strings 116 can slip through the coils of a notepad 112 in order to maintain the pad on the device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A notepad cover, comprising:

at least three panels, the at least three panels comprising a first panel, a second panel, and a third panel;

wherein the first panel is pivotally connected to a first end of the second panel and the third panel is pivotally connected to a second end of the second panel;

a plurality of strips of material having a first end and a second end, wherein the first end of each of the plurality of strips of material is connected to the first panel and the second end of each of the plurality of strips of material is connected to the first end of the second panel;

a first fastener disposed on the first panel;

a second panel disposed on the second fastener;

wherein the first fastener and the second fastener are adapted to secure a page of a notebook the notebook bound by a coil;

wherein an opening is disposed between each adjacent of the plurality of strips of material and each opening is configured to receive a segment of the coil therethrough.

2. The notepad cover of claim 1, wherein the third panel is pivotally connected to the second panel such that the third panel folds in between the notepad secured within the first panel and the second panel.

3. The notepad cover of claim of claim 1, wherein the fastener comprises a flat elastic band positioned vertically on an interior of the first panel and the second panel, the flat elastic band configured to secure the notepad thereunder.

4. The writing pad cover of claim 1, wherein the at least three panels further comprise a plurality of sleeves.

5. The writing pad cover of claim 1, wherein the first panel and second panel comprise a leather exterior.

6. The writing pad cover of claim 1, wherein the at least three panels are constructed from a material, the material comprising a rigid material.

7. The writing pad cover of claim 1, wherein the third panel is placed in between the notepad to separate pages of the notepad.

8. The writing pad cover of claim 1, wherein the at least three panels are sewn together.

9. The writing pad cover of claim 1, wherein each of the plurality of strips of material is a flat string.

* * * * *